US005852342A

United States Patent [19]

Kim et al.

[11] Patent Number: 5,852,342

[45] Date of Patent: Dec. 22, 1998

[54] DIRECTLY HEATED CATHODE STRUCTURE

[75] Inventors: Chang-seob Kim; Seok-bong Son, both of Kyungki-do; Bong-uk Jeong; Sang-kyun Kim, both of Seoul, all of Rep. of Korea

[73] Assignee: Samsung Display Devices Co., Ltd., Kyungki-do, Rep. of Korea

[21] Appl. No.: 834,731

[22] Filed: Apr. 3, 1997

[30] Foreign Application Priority Data

May 22, 1996 [KR] Rep. of Korea ..... 96-17465

[51] Int. Cl.[6] ..... H01J 1/14

[52] U.S. Cl. ..... 313/346 DC; 313/346 R; 313/345

[58] Field of Search ..... 313/346 DC, 346 R, 313/345, 341, 343

[56] References Cited

U.S. PATENT DOCUMENTS

| | | | |
|---|---|---|---|
| 3,983,443 | 9/1976 | Schde | 313/346 DC X |
| 4,587,455 | 5/1986 | Falce et al. | 313/346 DC |
| 4,658,181 | 4/1987 | Cooper et al. | 313/346 DC X |
| 5,668,434 | 9/1997 | Kim et al. | 313/346 R |

*Primary Examiner*—Ashok Patel
*Attorney, Agent, or Firm*—Leydig, Voit & Mayer

[57] ABSTRACT

A directly heated cathode structure includes a porous pellet impregnated with a thermionic emission material, a supporter for applying electrical power, and a filament fixed to the porous pellet, having an end, and fixed to the supporter, wherein the filament includes a connecting portion wider than the filament and fixed to the supporter at the end of the filament. The cathode structure is suitable for a color CRT such as a color television or a CRT for industrial use and having a large screen.

3 Claims, 2 Drawing Sheets

DIRECTLY HEATED CATHODE STRUCTURE

BACKGROUND OF THE INVENTION

The present invention relates to a directly heated type cathode structure for an electronic tube, and more particularly, to a directly heated type dispenser cathode structure of an electron gun for a color cathode ray tube (CRT).

In a thermionic cathode for emitting thermions by heat energy, there is an indirectly heated type where a filament and a thermion emission source are disposed being spaced from each other and a directly heated type where the filament and the thermion emission source directly contact each other.

The indirectly heated type cathode is generally applied to an electron gun which requires a large amount of thermions. These cathodes are divided into oxide cathodes and dispenser cathode.

In the directly heated type cathode which is directly fixed to the filament, there is a base metal and a storage medium. The base metal is mainly used for a small CRT electron gun for a viewfinder of a camcorder and is cooled with an oxide on a surface. The storage medium in a dispenser-type thermion emission source applied to a large CRT requiring a large amount of current is, e.g., a porous pellet impregnated with an electron emission material.

The structure of a porous pellet directly fixed to a filament which has been previously suggested by the present applicant is illustrated in detail in FIG. 1. As shown in the drawing, a filament 1 is directly fixed to the side of a porous pellet 2 impregnated with the electron emission material. In the above cathode structure, since the thickness and width of the filament 1 are uniform to be suitable for heating, it is difficult to have an end portion 1*a* of the filament 1 welded to a supporter 3, as shown in FIG. 2. Thus, there is a high rate of defective products and the welding strength is weak.

SUMMARY OF THE INVENTION

To solve the above problems, it is an object of the present invention to provide a directly heated cathode structure having an improved filament structure by which the weld inferiority between a supporter and a filament can be reduced.

Accordingly, to achieve the above object, there is provided a directly heated cathode structure comprising a porous pellet in which thermion emission material is impregnated, a supporter for applying electric power and a filament having an end is fixed to the porous pellet, and opposite end fixed to the supporter, wherein a connecting portion having a width wider than that of the filament and fixed to the supporter is located at the opposite end of the filament.

It is preferable that the connecting portion is integrally formed with the filament and that the shape of the connecting portion be circular or polygonal.

BRIEF DESCRIPTION OF THE DRAWINGS

The above object and advantages of the present invention will become more apparent by describing in detail a preferred embodiment with reference to the attached drawings in which.

DETAILED DESCRIPTION OF THE INVENTION

Figure 1:
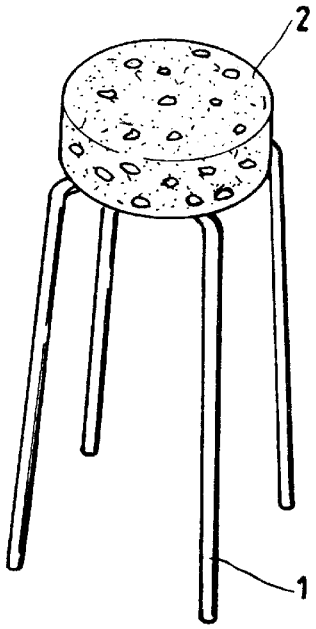
FIGS. 1 and 2 are perspective views illustrating the directly heated cathode structure which has been suggested by the present applicant.
Figure 2:
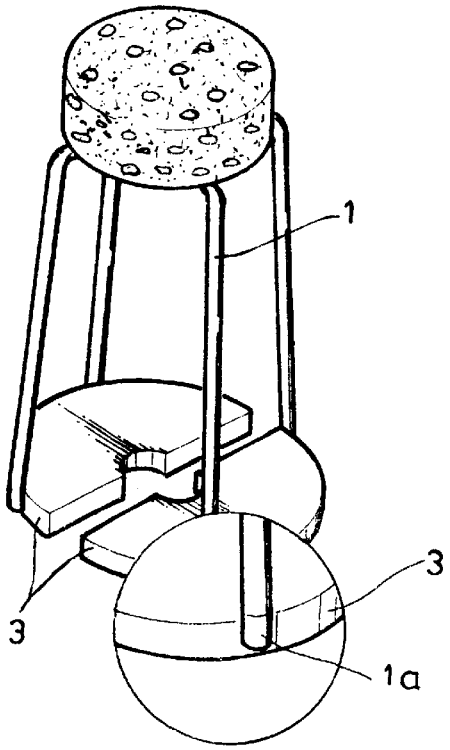
Figure 3:
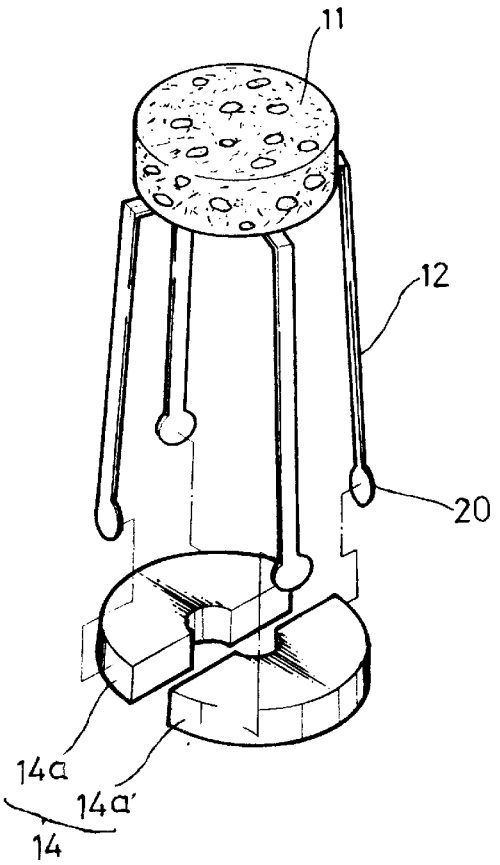
FIG. 3 is a perspective view illustrating a directly heated cathode structure according to the present invention.
Figure 4:
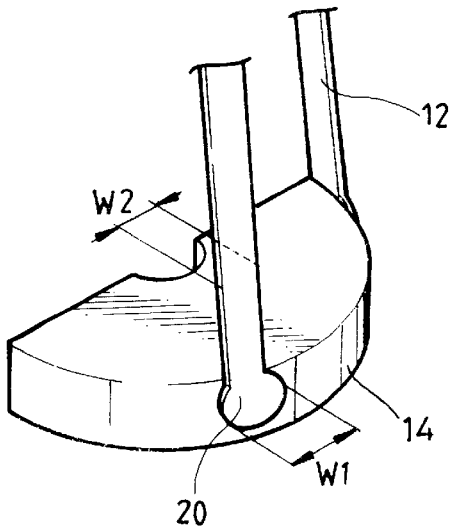
FIG. 4 is a perspective view illustrating a state in which a connecting portion of the directly heated cathode structure shown in FIG. 3 is welded to a supporter.

A preferred embodiment of a directly heated cathode structure according to the present invention is shown in FIGS. 3 and 4. Referring to the drawings, the directly heated cathode structure is comprised of a porous pellet 11 impregnated with a thermion emission material, a plurality of filaments 12 fixed to the porous pellet 11 for heating the pellet, and a supporter 14 to which the filaments 12 are fixed by welding, for applying electrical power to the filament 12. A connecting portion 20 to be welded at the supporter 14 is located at the end of each filament 12. The width W1 (see FIG. 4) of the connecting portion 20 is wider than the width W2 of the filament 12. The supporter 14 is comprised of semicircular plate members 14*a* and 14*a*' separated from each other by a predetermined distance. The connecting portion 20 of each filament 12 is fixedly welded at a side surface of the semicircular plate members 14*a* and 14*a*'.

The connecting portion 20 at the end portion of the filament 12 can be formed by pressing the end tip of a rod-shaped filament to enlarge the area of the end portion. Also, when the filament 12 is manufactured through etching, the connecting portion 20 can be integrally manufactured together with the filament 12. Further, it is preferable that the shape of the connecting portion 20 be circular or polygonal.

In the operation of the directly heated type cathode structure according to the present invention, when a predetermined power is supplied to each of the semicircular plate members 14*a* and 14*a*', the filament 12 is heated. Thus, the pellet 11 heated by the heat of the filament 12 emits thermions.

As described above, in the directly heated type cathode structure according to the present invention, the connection between the supporter 14 and the connecting portion 20 is stable and damage to the filament end portion during welding can be prevented due to the relatively enlarged weld area. Further, automation of welding work is facilitated and the rate of defective products due to welding can be reduced.

The cathode structure of the present invention is suitable for a color CRT such as a color television or a CRT for industrial use having a large screen.

It is noted that the present invention is not limited to the preferred embodiment described above, and it is apparent that variations and modifications by those skilled in the art can be effected within the spirit and scope of the present invention defined in the appended claims.

What is claimed is:

1. A directly heated cathode structure comprising a porous pellet impregnated with a thermionic emission material, a supporter for applying electrical power and a filament fixed to said porous pellet, having a width, having an end, and fixed to said supporter, wherein said filament includes a connecting portion wider than said filament and fixed to said supporter at said end of said filament.

2. The directly heated cathode structure as claimed in claim 1, wherein said connecting portion is integral with said filament.

3. The directly heated cathode structure as claimed in claim 1, wherein said connecting portion has a circular or polygonal shape.

* * * * *